US011512936B2

(12) United States Patent
Overton et al.

(10) Patent No.: US 11,512,936 B2
(45) Date of Patent: Nov. 29, 2022

(54) METHODS AND DEVICES METERING AND COMPACTING EXPLOSIVE POWDERS

(71) Applicant: TRUE VELOCITY IP HOLDINGS, LLC, Garland, TX (US)

(72) Inventors: Kenneth J. Overton, Princeton, TX (US); Peter Adkins, Arlington, TX (US); Tucker Siuts, Garland, TX (US)

(73) Assignee: TRUE VELOCITY IP HOLDINGS, LLC, Garland, TX (US)

( * ) Notice: Subject to any disclaimer, the term of this patent is extended or adjusted under 35 U.S.C. 154(b) by 250 days.

(21) Appl. No.: 16/822,313

(22) Filed: Mar. 18, 2020

(65) Prior Publication Data

US 2020/0363179 A1 Nov. 19, 2020

Related U.S. Application Data

(60) Provisional application No. 62/820,536, filed on Mar. 19, 2019, provisional application No. 62/820,531, filed on Mar. 19, 2019.

(51) Int. Cl.

| | |
|---|---|
| ***F42B 33/02*** | (2006.01) |
| ***F42B 3/00*** | (2006.01) |
| ***F42B 33/00*** | (2006.01) |

(52) U.S. Cl.

CPC ..... *F42B 33/025* (2013.01); *F42B 3/00* (2013.01); *F42B 33/001* (2013.01); *F42B 33/002* (2013.01); *F42B 33/0207* (2013.01)

(58) Field of Classification Search

CPC .... F42B 33/025; F42B 33/001; F42B 33/002; F42B 33/0207; F42B 3/00

See application file for complete search history.

(56) References Cited

U.S. PATENT DOCUMENTS

| | | | |
|---|---|---|---|
| 99,528 | A | 2/1870 | Boyd |
| 113,634 | A | 4/1871 | Crispin |

(Continued)

FOREIGN PATENT DOCUMENTS

| | | | |
|---|---|---|---|
| CA | 2813634 | A1 | 4/2012 |
| CN | 102901403 | B | 6/2014 |

(Continued)

OTHER PUBLICATIONS

International Search Report and Written Opinion in PCT/US2020/023273 dated Oct. 7, 2020; pp. 1-11.

(Continued)

*Primary Examiner* — Samir Abdosh

(74) *Attorney, Agent, or Firm* — Burdick Patents, P.A.; Sean Burdick

(57) ABSTRACT

The present invention includes a powder compaction device comprising a loading platform positioned above a lower platform; a compaction rod aperture positioned in the loading platform; a vertical tube positioned in communication with the compaction rod aperture; a compaction rod positioned in the compaction rod aperture and extending through the compaction rod aperture, wherein the compaction rod comprises one or more reliefs having a powder volume; a drive motor in communication with the vertical tube and connected to the compaction rod to move the compaction rod through the compaction rod aperture; a first funnel-shaped device positioned below the loading platform, wherein the first funnel-shaped device comprises a first funnel aperture, wherein the first funnel aperture aligns with the compaction rod aperture to move the compaction rod through the compaction rod aperture and the first funnel aperture; an adaptor platform secured to the lower platform and aligned with the compaction rod aperture; an ammunition cartridge fixture slidably secured in the adaptor plat- (Continued)

form, wherein the ammunition cartridge fixture comprises a funnel-shaped opening, an interior cartridge shaped void, and a funnel aperture connecting the funnel-shaped opening to the interior cartridge shaped void, wherein the funnel aperture is aligned with the compaction rod aperture and the first funnel aperture to accommodate the compaction movement of the compaction rod; an ammunition cartridge positioned in the ammunition cartridge fixture; a powder reservoir positioned in communication with the first funnel-shaped device to transport powder to the first funnel-shaped device; a compaction controller in communication with the drive motor and one or more sensors to control the direction of the motor to control the direction of movement of the compaction rod and the force applied to the compaction rod to control the compaction of the powder; and a powder metering controller in communication with the gate and one or more second sensors to control the amount of powder delivered and he powder is despised.

17 Claims, 3 Drawing Sheets

(56) References Cited

U.S. PATENT DOCUMENTS 130,679 A 8/1872 Whitmore
159,665 A 2/1875 Gauthey
169,807 A 11/1875 Hart
207,248 A 8/1878 Bush et al.
207,853 A * 9/1878 Dazell ..... F42B 33/0292 86/31
462,611 A 11/1891 Comte de Sparre
475,008 A 5/1892 Bush
498,856 A 6/1893 Overbaugh
498,857 A 6/1893 Overbaugh
640,856 A 1/1900 Bailey
662,137 A 11/1900 Tellerson
676,000 A 6/1901 Henneberg
743,242 A 11/1903 Bush
747,422 A * 12/1903 Helm ..... F42B 33/0292 86/31
865,979 A 9/1907 Bailey
869,046 A 10/1907 Bailey
905,358 A 12/1908 Peters
957,171 A 5/1910 Loeb
963,911 A 7/1910 Loeble
1,060,817 A 5/1913 Clyne
1,060,818 A 5/1913 Clyne
1,064,907 A 6/1913 Hoagland
1,187,464 A 6/1916 Offutt
1,842,445 A 1/1932 Clyne
1,936,905 A 11/1933 Gaidos
1,940,657 A 12/1933 Woodford
2,294,822 A 9/1942 Norman
2,465,962 A 3/1949 Allen et al.
2,506,144 A * 5/1950 Fischer ..... F42B 33/001 86/12
2,654,319 A 10/1953 Roske
2,823,611 A 2/1958 Thayer
2,862,446 A 12/1958 Lars
2,918,868 A 12/1959 Lars
2,936,709 A 5/1960 Seavey
2,953,990 A 9/1960 Miller
2,972,947 A 2/1961 Fitzsimmons et al.
3,034,433 A 5/1962 Karl
3,099,958 A 8/1963 Daubenspeck et al.
3,157,121 A 11/1964 Daubenspeck et al.
3,159,701 A 12/1964 Herter
3,170,401 A 2/1965 Johnson et al.
3,171,350 A 3/1965 Metcalf et al.
3,242,789 A 3/1966 Woodring
3,246,603 A 4/1966 Comerford
3,253,496 A * 5/1966 Beach ..... F42B 33/0207 86/32
3,256,815 A 6/1966 Davidson et al.
3,288,066 A 11/1966 Hans et al.
3,292,538 A 12/1966 Hans et al.
3,332,352 A 7/1967 Olson et al.
3,444,777 A 5/1969 Lage
3,446,146 A 5/1969 Stadler et al.
3,485,170 A 12/1969 Scanlon
3,485,173 A 12/1969 Morgan
3,491,691 A 1/1970 Vawter
3,565,008 A 2/1971 Gulley et al.
3,590,740 A 7/1971 Herter
3,609,904 A 10/1971 Scanlon
3,614,929 A 10/1971 Herter et al.
3,659,528 A 5/1972 Santala
3,688,699 A 9/1972 Horn et al.
3,690,256 A 9/1972 Schnitzer
3,745,924 A 7/1973 Scanlon
3,749,021 A 7/1973 Burgess
3,756,156 A 9/1973 Schuster
3,765,297 A 10/1973 Skochko et al.
3,768,413 A 10/1973 Ramsay
3,786,755 A 1/1974 Eckstein et al.
3,797,396 A 3/1974 Reed
3,842,739 A 10/1974 Scanlon et al.
3,866,536 A 2/1975 Greenberg
3,874,294 A 4/1975 Hale
3,955,506 A 5/1976 Luther et al.
3,977,326 A 8/1976 Anderson et al.
3,990,366 A 11/1976 Scanlon
4,005,630 A 2/1977 Patrick
4,020,763 A 5/1977 Iruretagoyena
4,132,173 A 1/1979 Amuchastegui
4,147,107 A 4/1979 Ringdal
4,157,684 A 6/1979 Clausser
4,173,186 A 11/1979 Dunham
4,179,992 A 12/1979 Ramnarace et al.
4,187,271 A 2/1980 Rolston et al.
4,228,724 A 10/1980 Leich
4,276,830 A 7/1981 Alice
4,353,304 A 10/1982 Hubsch et al.
4,475,435 A 10/1984 Mantel
4,483,251 A 11/1984 Spalding
4,598,445 A 7/1986 O'Connor
4,614,157 A 9/1986 Grelle et al.
4,679,505 A 7/1987 Reed
4,718,348 A 1/1988 Ferrigno
4,719,859 A 1/1988 Ballreich et al.
4,726,296 A 2/1988 Leshner et al.
4,763,576 A 8/1988 Kass et al.
4,867,065 A 9/1989 Kaltmann et al.
4,970,959 A 11/1990 Bilsbury et al.
5,021,206 A 6/1991 Stoops
5,033,386 A 7/1991 Vatsvog
5,063,853 A 11/1991 Bilgeri
5,090,327 A 2/1992 Bilgeri
5,151,555 A 9/1992 Vatsvog
5,165,040 A 11/1992 Andersson et al.
5,237,930 A 8/1993 Belanger et al.
5,247,888 A 9/1993 Conil
5,259,288 A 11/1993 Vatsvog
5,265,540 A 11/1993 Ducros et al.
D345,676 S 4/1994 Biffle
5,433,148 A 7/1995 Barratault et al.
5,535,495 A 7/1996 Gutowski
5,563,365 A 10/1996 Dineen et al.
5,616,642 A 4/1997 West et al.
D380,650 S 7/1997 Norris
5,679,920 A 10/1997 Hallis et al.
5,758,445 A 6/1998 Casull
5,770,815 A 6/1998 Watson
5,798,478 A 8/1998 Beal
5,950,063 A 9/1999 Hens et al.
5,961,200 A 10/1999 Friis
5,969,288 A 10/1999 Baud
5,979,331 A 11/1999 Casull
6,004,682 A 12/1999 Rackovan et al.
6,048,379 A 4/2000 Bray et al.

(56) References Cited

U.S. PATENT DOCUMENTS

| | | | |
|---|---|---|---|
| 6,070,532 | A | 6/2000 | Halverson |
| D435,626 | S | 12/2000 | Benini |
| 6,257,148 | B1 | 7/2001 | Toivonen et al. |
| 6,257,149 | B1 | 7/2001 | Cesaroni |
| D447,209 | S | 8/2001 | Benini |
| 6,272,993 | B1 | 8/2001 | Cook et al. |
| 6,283,035 | B1 | 9/2001 | Olson et al. |
| 6,357,357 | B1 | 3/2002 | Glasser |
| D455,052 | S | 4/2002 | Gullickson et al. |
| D455,320 | S | 4/2002 | Edelstein |
| 6,375,971 | B1 | 4/2002 | Hansen |
| 6,408,764 | B1 | 6/2002 | Heitmann et al. |
| 6,450,099 | B1 | 9/2002 | Desgland |
| 6,460,464 | B1 | 10/2002 | Attarwala |
| 6,523,476 | B1 | 2/2003 | Riess et al. |
| 6,644,204 | B2 | 11/2003 | Pierrot et al. |
| 6,649,095 | B2 | 11/2003 | Buja |
| 6,672,219 | B2 | 1/2004 | Mackerell et al. |
| 6,708,621 | B1 | 3/2004 | Forichon-Chaumet et al. |
| 6,752,084 | B1 | 6/2004 | Husseini et al. |
| 6,796,243 | B2 | 9/2004 | Schmees et al. |
| 6,810,816 | B2 | 11/2004 | Rennard |
| 6,840,149 | B2 | 1/2005 | Beal |
| 6,845,716 | B2 | 1/2005 | Husseini et al. |
| 7,000,547 | B2 | 2/2006 | Amick |
| 7,014,284 | B2 | 3/2006 | Morton et al. |
| 7,032,492 | B2 | 4/2006 | Meshirer |
| 7,056,091 | B2 | 6/2006 | Powers |
| 7,059,234 | B2 | 6/2006 | Husseini |
| 7,159,519 | B2 | 1/2007 | Robinson et al. |
| 7,165,496 | B2 | 1/2007 | Reynolds |
| D540,710 | S | 4/2007 | Charrin |
| 7,204,191 | B2 | 4/2007 | Wiley et al. |
| 7,213,519 | B2 | 5/2007 | Wiley et al. |
| 7,231,519 | B2 | 6/2007 | Joseph et al. |
| 7,232,473 | B2 | 6/2007 | Elliott |
| 7,299,750 | B2 | 11/2007 | Schikora et al. |
| 7,353,756 | B2 | 4/2008 | Leasure |
| 7,380,505 | B1 | 6/2008 | Shiery |
| 7,383,776 | B2 | 6/2008 | Amick |
| 7,392,746 | B2 | 7/2008 | Hansen |
| 7,426,888 | B2 | 9/2008 | Hunt |
| 7,441,504 | B2 | 10/2008 | Husseini et al. |
| D583,927 | S | 12/2008 | Benner |
| 7,458,322 | B2 | 12/2008 | Reynolds et al. |
| 7,461,597 | B2 | 12/2008 | Brunn |
| 7,568,417 | B1 | 8/2009 | Lee |
| 7,585,166 | B2 | 9/2009 | Buja |
| 7,610,858 | B2 | 11/2009 | Chung |
| 7,750,091 | B2 | 7/2010 | Maljkovic et al. |
| D626,619 | S | 11/2010 | Gogol et al. |
| 7,841,279 | B2 | 11/2010 | Reynolds et al. |
| D631,699 | S | 2/2011 | Moreau |
| D633,166 | S | 2/2011 | Richardson et al. |
| 7,908,972 | B2 | 3/2011 | Brunn |
| 7,930,977 | B2 | 4/2011 | Klein |
| 3,007,370 | A1 | 8/2011 | Hirsch et al. |
| 8,056,232 | B2 | 11/2011 | Patel et al. |
| 8,156,870 | B2 | 4/2012 | South |
| 8,186,273 | B2 | 5/2012 | Trivette |
| 8,191,480 | B2 | 6/2012 | Mcaninch |
| 8,201,867 | B2 | 6/2012 | Thomeczek |
| 8,206,522 | B2 | 6/2012 | Sandstrom et al. |
| 8,220,393 | B2 | 7/2012 | Schluckebier et al. |
| 8,240,252 | B2 | 8/2012 | Maljkovic et al. |
| D675,882 | S | 2/2013 | Crockett |
| 8,393,273 | B2 | 3/2013 | Weeks et al. |
| 8,408,137 | B2 | 4/2013 | Battaglia |
| D683,419 | S | 5/2013 | Rebar |
| 8,443,729 | B2 | 5/2013 | Mittelstaedt |
| 8,443,730 | B2 | 5/2013 | Padgett |
| 8,464,641 | B2 | 6/2013 | Se-Hong |
| 8,511,233 | B2 | 8/2013 | Nilsson |
| D689,975 | S | 9/2013 | Carlson et al. |
| 8,522,684 | B2 | 9/2013 | Davies et al. |
| 8,540,828 | B2 | 9/2013 | Busky et al. |
| 8,561,543 | B2 | 10/2013 | Burrow |
| 8,573,126 | B2 | 11/2013 | Klein et al. |
| 8,641,842 | B2 | 2/2014 | Hafner et al. |
| 8,689,696 | B1 | 4/2014 | Seeman et al. |
| 8,763,535 | B2 | 7/2014 | Padgett |
| 8,783,154 | B1 | 7/2014 | Windham et al. |
| 8,790,455 | B2 | 7/2014 | Borissov et al. |
| 8,807,008 | B2 | 8/2014 | Padgett et al. |
| 8,807,040 | B2 | 8/2014 | Menefee, III |
| 8,813,650 | B2 | 8/2014 | Maljkovic et al. |
| D715,888 | S | 10/2014 | Padgett |
| 8,850,985 | B2 | 10/2014 | Maljkovic et al. |
| 8,857,343 | B2 | 10/2014 | Marx |
| 8,869,702 | B2 | 10/2014 | Padgett |
| D717,909 | S | 11/2014 | Thrift et al. |
| 8,875,633 | B2 | 11/2014 | Padgett |
| 8,893,621 | B1 | 11/2014 | Escobar |
| 8,915,191 | B2 | 12/2014 | Jones |
| 8,978,559 | B2 | 3/2015 | Davies et al. |
| 8,985,023 | B2 | 3/2015 | Mason |
| 9,003,973 | B1 | 4/2015 | Padgett |
| 9,032,855 | B1 | 5/2015 | Foren et al. |
| 9,091,516 | B2 | 7/2015 | Davies et al. |
| 9,103,641 | B2 | 8/2015 | Nielson et al. |
| 9,111,177 | B2 | 8/2015 | Tateno et al. |
| 9,157,709 | B2 | 10/2015 | Nuetzman et al. |
| 9,170,080 | B2 | 10/2015 | Poore et al. |
| 9,182,204 | B2 | 11/2015 | Maljkovic et al. |
| 9,188,412 | B2 | 11/2015 | Maljkovic et al. |
| 9,200,157 | B2 | 12/2015 | El-Hibri et al. |
| 9,200,878 | B2 | 12/2015 | Seecamp |
| 9,200,880 | B1 | 12/2015 | Foren et al. |
| 9,212,876 | B1 | 12/2015 | Kostka et al. |
| 9,212,879 | B2 | 12/2015 | Whitworth |
| 9,213,175 | B2 | 12/2015 | Arnold |
| 9,254,503 | B2 | 2/2016 | Ward |
| 9,255,775 | B1 | 2/2016 | Rubin |
| D752,397 | S | 3/2016 | Seiders et al. |
| 9,273,941 | B2 | 3/2016 | Carlson et al. |
| D754,223 | S | 4/2016 | Pederson et al. |
| 9,329,004 | B2 | 5/2016 | Pace |
| 9,335,137 | B2 | 5/2016 | Maljkovic et al. |
| 9,337,278 | B1 | 5/2016 | Gu et al. |
| 9,347,457 | B2 | 5/2016 | Ahrens et al. |
| 9,366,512 | B2 | 6/2016 | Burczynski et al. |
| 9,372,054 | B2 | 6/2016 | Padgett |
| 9,377,278 | B2 | 6/2016 | Rubin |
| 9,389,052 | B2 | 7/2016 | Conroy et al. |
| 9,395,165 | B2 | 7/2016 | Maljkovic et al. |
| D764,624 | S | 8/2016 | Masinelli |
| D765,214 | S | 8/2016 | Padgett |
| 9,429,407 | B2 | 8/2016 | Burrow |
| 9,441,930 | B2 | 9/2016 | Burrow |
| 9,453,714 | B2 | 9/2016 | Bosarge et al. |
| D773,009 | S | 11/2016 | Bowers |
| 9,500,453 | B2 | 11/2016 | Schluckebier et al. |
| 9,506,735 | B1 | 11/2016 | Burrow |
| D774,824 | S | 12/2016 | Gallagher |
| 9,513,092 | B2 | 12/2016 | Emary |
| 9,513,096 | B2 | 12/2016 | Burrow |
| 9,518,810 | B1 | 12/2016 | Burrow |
| 9,523,563 | B1 | 12/2016 | Burrow |
| 9,528,799 | B2 | 12/2016 | Maljkovic |
| 9,546,849 | B2 | 1/2017 | Burrow |
| 9,551,557 | B1 | 1/2017 | Burrow |
| D778,391 | S | 2/2017 | Burrow |
| D778,393 | S | 2/2017 | Burrow |
| D778,394 | S | 2/2017 | Burrow |
| D778,395 | S | 2/2017 | Burrow |
| D779,021 | S | 2/2017 | Burrow |
| D779,024 | S | 2/2017 | Burrow |
| D780,283 | S | 2/2017 | Burrow |
| 9,587,918 | B1 | 3/2017 | Burrow |
| 9,599,443 | B2 | 3/2017 | Padgett et al. |
| 9,625,241 | B2 | 4/2017 | Neugebauer |
| 9,631,907 | B2 | 4/2017 | Burrow |
| 9,644,930 | B1 | 5/2017 | Burrow |
| 9,658,042 | B2 | 5/2017 | Emary |

(56) References Cited

U.S. PATENT DOCUMENTS

| | | | |
|---|---|---|---|
| 9,683,818 | B2 | 6/2017 | Lemke et al. |
| D792,200 | S | 7/2017 | Baiz et al. |
| 9,709,368 | B2 | 7/2017 | Mahnke |
| D797,880 | S | 9/2017 | Seecamp |
| 9,759,554 | B2 | 9/2017 | Ng et al. |
| D800,244 | S | 10/2017 | Burczynski et al. |
| D800,245 | S | 10/2017 | Burczynski et al. |
| D800,246 | S | 10/2017 | Burczynski et al. |
| 9,784,667 | B2 | 10/2017 | Lukay et al. |
| 9,835,423 | B2 | 12/2017 | Burrow |
| 9,835,427 | B2 | 12/2017 | Burrow |
| 9,841,248 | B2 | 12/2017 | Bybee |
| 9,857,151 | B2 | 1/2018 | Dionne et al. |
| 9,869,536 | B2 | 1/2018 | Burrow |
| 9,879,954 | B2 | 1/2018 | Hajjar |
| 9,885,551 | B2 | 2/2018 | Burrow |
| D813,975 | S | 3/2018 | White |
| 9,921,040 | B2 | 3/2018 | Rubin |
| 9,927,219 | B2 | 3/2018 | Burrow |
| 9,933,241 | B2 | 4/2018 | Burrow |
| 9,939,236 | B2 | 4/2018 | Drobockyi et al. |
| 9,964,388 | B1 | 5/2018 | Burrow |
| D821,536 | S | 6/2018 | Christiansen et al. |
| 9,989,339 | B2 | 6/2018 | Riess |
| 9,989,343 | B2 | 6/2018 | Padgett et al. |
| 10,041,770 | B2 | 8/2018 | Burrow |
| 10,041,771 | B1 | 8/2018 | Burrow |
| 10,041,776 | B1 | 8/2018 | Burrow |
| 10,041,777 | B1 | 8/2018 | Burrow |
| 10,048,049 | B2 | 8/2018 | Burrow |
| 10,048,050 | B1 | 8/2018 | Burrow |
| 10,048,052 | B2 | 8/2018 | Burrow |
| 10,054,413 | B1 | 8/2018 | Burrow |
| D828,483 | S | 9/2018 | Burrow |
| 10,081,057 | B2 | 9/2018 | Burrow |
| D832,037 | S | 10/2018 | Gallagher |
| 10,101,140 | B2 | 10/2018 | Burrow |
| 10,124,343 | B2 | 11/2018 | Tsai |
| 10,145,662 | B2 | 12/2018 | Burrow |
| 10,190,857 | B2 | 1/2019 | Burrow |
| 10,234,249 | B2 | 3/2019 | Burrow |
| 10,234,253 | B2 | 3/2019 | Burrow |
| 10,240,905 | B2 | 3/2019 | Burrow |
| 10,254,096 | B2 | 4/2019 | Burrow |
| 10,260,847 | B2 | 4/2019 | Viggiano et al. |
| D849,181 | S | 5/2019 | Burrow |
| 10,302,393 | B2 | 5/2019 | Grace |
| 10,302,403 | B2 | 5/2019 | Burrow |
| 10,302,404 | B2 | 5/2019 | Burrow |
| 10,323,918 | B2 | 6/2019 | Menefee, III |
| 10,330,451 | B2 | 6/2019 | Burrow |
| 10,345,088 | B2 | 7/2019 | Burrow |
| 10,352,664 | B2 | 7/2019 | Burrow |
| 10,352,670 | B2 | 7/2019 | Burrow |
| 10,359,262 | B2 | 7/2019 | Burrow |
| 10,365,074 | B2 | 7/2019 | Burrow |
| D861,118 | S | 9/2019 | Burrow |
| D861,119 | S | 9/2019 | Burrow |
| 10,408,582 | B2 | 9/2019 | Burrow |
| 10,408,592 | B2 | 9/2019 | Boss et al. |
| 10,415,943 | B2 | 9/2019 | Burrow |
| 10,429,156 | B2 | 10/2019 | Burrow |
| 10,458,762 | B2 | 10/2019 | Burrow |
| 10,466,020 | B2 | 11/2019 | Burrow |
| 10,466,021 | B2 | 11/2019 | Burrow |
| 10,480,911 | B2 | 11/2019 | Burrow |
| 10,480,912 | B2 | 11/2019 | Burrow |
| 10,480,915 | B2 | 11/2019 | Burrow et al. |
| 10,488,165 | B2 | 11/2019 | Burrow |
| 10,533,830 | B2 | 1/2020 | Burrow et al. |
| 10,571,162 | B2 | 2/2020 | Makansi et al. |
| 10,571,228 | B2 | 2/2020 | Burrow |
| 10,571,229 | B2 | 2/2020 | Burrow |
| 10,571,230 | B2 | 2/2020 | Burrow |
| 10,571,231 | B2 | 2/2020 | Burrow |
| 10,578,409 | B2 | 3/2020 | Burrow |
| 10,591,260 | B2 | 3/2020 | Burrow et al. |
| D882,019 | S | 4/2020 | Burrow et al. |
| D882,020 | S | 4/2020 | Burrow et al. |
| D882,021 | S | 4/2020 | Burrow et al. |
| D882,022 | S | 4/2020 | Burrow et al. |
| D882,023 | S | 4/2020 | Burrow et al. |
| D882,024 | S | 4/2020 | Burrow et al. |
| D882,025 | S | 4/2020 | Burrow et al. |
| D882,026 | S | 4/2020 | Burrow et al. |
| D882,027 | S | 4/2020 | Burrow et al. |
| D882,028 | S | 4/2020 | Burrow et al. |
| D882,029 | S | 4/2020 | Burrow et al. |
| D882,030 | S | 4/2020 | Burrow et al. |
| D882,031 | S | 4/2020 | Burrow et al. |
| D882,032 | S | 4/2020 | Burrow et al. |
| D882,033 | S | 4/2020 | Burrow et al. |
| D882,720 | S | 4/2020 | Burrow et al. |
| D882,721 | S | 4/2020 | Burrow et al. |
| D882,722 | S | 4/2020 | Burrow et al. |
| D882,723 | S | 4/2020 | Burrow et al. |
| D882,724 | S | 4/2020 | Burrow et al. |
| 10,612,896 | B2 | 4/2020 | Burrow |
| 10,612,897 | B2 | 4/2020 | Burrow et al. |
| D884,115 | S | 5/2020 | Burrow et al. |
| 10,663,271 | B2 | 5/2020 | Rogers |
| D886,231 | S | 6/2020 | Burrow et al. |
| D886,937 | S | 6/2020 | Burrow et al. |
| 10,677,573 | B2 | 6/2020 | Burrow et al. |
| D891,567 | S | 7/2020 | Burrow et al. |
| D891,568 | S | 7/2020 | Burrow et al. |
| D891,569 | S | 7/2020 | Burrow et al. |
| D891,570 | S | 7/2020 | Burrow et al. |
| 10,704,869 | B2 | 7/2020 | Burrow et al. |
| 10,704,870 | B2 | 7/2020 | Burrow et al. |
| 10,704,871 | B2 | 7/2020 | Burrow et al. |
| 10,704,872 | B1 | 7/2020 | Burrow et al. |
| 10,704,876 | B2 | 7/2020 | Boss et al. |
| 10,704,877 | B2 | 7/2020 | Boss et al. |
| 10,704,878 | B2 | 7/2020 | Boss et al. |
| 10,704,879 | B1 | 7/2020 | Burrow et al. |
| 10,704,880 | B1 | 7/2020 | Burrow et al. |
| D892,258 | S | 8/2020 | Burrow et al. |
| D893,665 | S | 8/2020 | Burrow et al. |
| D893,666 | S | 8/2020 | Burrow et al. |
| D893,667 | S | 8/2020 | Burrow et al. |
| D893,668 | S | 8/2020 | Burrow et al. |
| D894,320 | S | 8/2020 | Burrow et al. |
| 10,731,956 | B2 | 8/2020 | Burrow et al. |
| 10,731,957 | B1 | 8/2020 | Burrow et al. |
| 10,753,713 | B2 | 8/2020 | Burrow |
| 10,760,882 | B1 | 9/2020 | Burrow |
| 10,782,107 | B1 | 9/2020 | Dindl |
| 10,794,671 | B2 | 10/2020 | Padgett et al. |
| 10,809,043 | B2 | 10/2020 | Padgett et al. |
| D903,038 | S | 11/2020 | Burrow et al. |
| D903,039 | S | 11/2020 | Burrow et al. |
| 10,845,169 | B2 | 11/2020 | Burrow |
| 10,852,108 | B2 | 12/2020 | Burrow et al. |
| 10,859,352 | B2 | 12/2020 | Burrow |
| 10,871,361 | B2 | 12/2020 | Skowron et al. |
| 10,876,822 | B2 | 12/2020 | Burrow et al. |
| 10,900,760 | B2 | 1/2021 | Burrow |
| 10,907,944 | B2 | 2/2021 | Burrow |
| 10,914,558 | B2 | 2/2021 | Burrow |
| 10,921,100 | B2 | 2/2021 | Burrow et al. |
| 10,921,101 | B2 | 2/2021 | Burrow et al. |
| 10,921,106 | B2 | 2/2021 | Burrow et al. |
| D913,403 | S | 3/2021 | Burrow et al. |
| 10,948,272 | B1 | 3/2021 | Drobockyi et al. |
| 10,948,273 | B2 | 3/2021 | Burrow et al. |
| 10,948,275 | B2 | 3/2021 | Burrow |
| 10,962,338 | B2 | 3/2021 | Burrow |
| 10,976,144 | B1 | 4/2021 | Peterson et al. |
| 10,996,029 | B2 | 5/2021 | Burrow |
| 10,996,030 | B2 | 5/2021 | Burrow |
| 11,047,654 | B1 | 6/2021 | Burrow |
| 11,047,655 | B2 | 6/2021 | Burrow et al. |
| 11,047,661 | B2 | 6/2021 | Burrow |

(56) References Cited

U.S. PATENT DOCUMENTS 11,047,662 B2 6/2021 Burrow
11,047,663 B1 6/2021 Burrow
11,047,664 B2 6/2021 Burrow
11,079,205 B2 8/2021 Burrow et al.
11,079,209 B2 8/2021 Burrow
11,085,739 B2 8/2021 Burrow
11,085,740 B2 8/2021 Burrow
11,085,741 B2 8/2021 Burrow
11,085,742 B2 8/2021 Burrow
11,092,413 B2 8/2021 Burrow
11,098,990 B2 8/2021 Burrow
11,098,991 B2 8/2021 Burrow
11,098,992 B2 8/2021 Burrow
11,098,993 B2 8/2021 Burrow
11,112,224 B2 9/2021 Burrow et al.
11,112,225 B2 9/2021 Burrow et al.
11,118,875 B1 9/2021 Burrow
11,118,876 B2 9/2021 Burrow et al.
11,118,877 B2 9/2021 Burrow et al.
11,118,882 B2 9/2021 Burrow
11,125,540 B2 9/2021 Pennell et al.
2003/0127011 A1 7/2003 Mackerell et al.
2004/0074412 A1 4/2004 Kightlinger
2004/0200340 A1 10/2004 Robinson et al.
2005/0056183 A1 3/2005 Meshirer
2005/0081704 A1 4/2005 Husseini
2005/0257712 A1 11/2005 Husseini et al.
2006/0027125 A1 2/2006 Brunn
2006/0278116 A1 12/2006 Hunt
2006/0283345 A1 12/2006 Feldman et al.
2007/0056343 A1 3/2007 Cremonesi
2007/0181029 A1 8/2007 Mcaninch
2007/0214992 A1 9/2007 Dittrich
2007/0214993 A1 9/2007 Cerovic et al.
2007/0267587 A1 11/2007 Dalluge
2010/0101444 A1 4/2010 Schluckebier et al.
2010/0212533 A1 8/2010 Brunn
2010/0234132 A1 9/2010 Hirsch et al.
2010/0258023 A1 10/2010 Reynolds et al.
2010/0282112 A1 11/2010 Battaglia
2011/0179965 A1 7/2011 Mason
2012/0024183 A1 2/2012 Klein
2012/0060716 A1 3/2012 Davies et al.
2012/0111219 A1 5/2012 Burrow
2012/0180685 A1 7/2012 Se-Hong
2012/0180687 A1 7/2012 Padgett et al.
2012/0291655 A1 11/2012 Jones
2013/0008335 A1 1/2013 Menefee, I
2013/0014664 A1 1/2013 Padgett
2013/0076865 A1 3/2013 Tateno et al.
2013/0186294 A1 7/2013 Davies et al.
2013/0291711 A1 11/2013 Mason
2014/0075805 A1 3/2014 LaRue
2014/0224144 A1 8/2014 Neugebauer
2014/0260925 A1 9/2014 Beach et al.
2014/0261044 A1 9/2014 Seecamp
2014/0311332 A1 10/2014 Carlson et al.
2015/0075400 A1 3/2015 Lemke et al.
2015/0226220 A1 8/2015 Bevington
2015/0268020 A1 9/2015 Emary
2016/0003585 A1 1/2016 Carpenter et al.
2016/0003589 A1 1/2016 Burrow
2016/0003590 A1 1/2016 Burrow
2016/0003593 A1 1/2016 Burrow
2016/0003594 A1 1/2016 Burrow
2016/0003595 A1 1/2016 Burrow
2016/0003596 A1 1/2016 Burrow
2016/0003597 A1 1/2016 Burrow
2016/0003601 A1 1/2016 Burrow
2016/0033241 A1 2/2016 Burrow
2016/0102030 A1 4/2016 Coffey et al.
2016/0146585 A1 5/2016 Padgett
2016/0216088 A1 7/2016 Maljkovic et al.
2016/0245626 A1 8/2016 Drieling et al.
2016/0265886 A1 9/2016 Aldrich et al.
2016/0349022 A1 12/2016 Burrow
2016/0349023 A1 12/2016 Burrow
2016/0349028 A1 12/2016 Burrow
2016/0356588 A1 12/2016 Burrow
2016/0377399 A1 12/2016 Burrow
2017/0030690 A1 2/2017 Viggiano et al.
2017/0030692 A1 2/2017 Drobockyi et al.
2017/0080498 A1 3/2017 Burrow
2017/0082409 A1 3/2017 Burrow
2017/0082411 A1 3/2017 Burrow
2017/0089673 A1 3/2017 Burrow
2017/0089674 A1 3/2017 Burrow
2017/0089675 A1 3/2017 Burrow
2017/0089679 A1 3/2017 Burrow
2017/0115105 A1 4/2017 Burrow
2017/0153093 A9 6/2017 Burrow
2017/0153099 A9 6/2017 Burrow
2017/0191812 A1 7/2017 Padgett et al.
2017/0199018 A9 7/2017 Burrow
2017/0205217 A9 7/2017 Burrow
2017/0261296 A1 9/2017 Burrow
2017/0299352 A9 10/2017 Burrow
2017/0328689 A1 11/2017 Dindl
2018/0066925 A1 3/2018 Skowron et al.
2018/0106581 A1 4/2018 Rogers
2018/0224252 A1 8/2018 O'Rourke
2018/0224253 A1 8/2018 Burrow
2018/0224256 A1 8/2018 Burrow
2018/0259310 A1 9/2018 Burrow
2018/0292186 A1 10/2018 Padgett et al.
2018/0306558 A1 10/2018 Padgett et al.
2019/0011233 A1 1/2019 Boss et al.
2019/0011234 A1 1/2019 Boss et al.
2019/0011235 A1 1/2019 Boss et al.
2019/0011236 A1 1/2019 Burrow
2019/0011237 A1 1/2019 Burrow
2019/0011238 A1 1/2019 Burrow
2019/0011239 A1 1/2019 Burrow
2019/0011240 A1 1/2019 Burrow
2019/0011241 A1 1/2019 Burrow
2019/0025019 A1 1/2019 Burrow
2019/0025020 A1 1/2019 Burrow
2019/0025021 A1 1/2019 Burrow
2019/0025022 A1 1/2019 Burrow
2019/0025023 A1 1/2019 Burrow
2019/0025024 A1 1/2019 Burrow
2019/0025025 A1 1/2019 Burrow
2019/0025026 A1 1/2019 Burrow
2019/0025035 A1 1/2019 Burrow
2019/0078862 A1 3/2019 Burrow
2019/0106364 A1 4/2019 James
2019/0107375 A1 4/2019 Burrow
2019/0137228 A1 5/2019 Burrow et al.
2019/0137229 A1 5/2019 Burrow et al.
2019/0137230 A1 5/2019 Burrow et al.
2019/0137231 A1 5/2019 Burrow et al.
2019/0137233 A1 5/2019 Burrow et al.
2019/0137234 A1 5/2019 Burrow et al.
2019/0137235 A1 5/2019 Burrow et al.
2019/0137236 A1 5/2019 Burrow et al.
2019/0137237 A1 5/2019 Burrow et al.
2019/0137238 A1 5/2019 Burrow et al.
2019/0137239 A1 5/2019 Burrow et al.
2019/0137240 A1 5/2019 Burrow et al.
2019/0137241 A1 5/2019 Burrow et al.
2019/0137242 A1 5/2019 Burrow et al.
2019/0137243 A1 5/2019 Burrow et al.
2019/0137244 A1 5/2019 Burrow et al.
2019/0170488 A1 6/2019 Burrow
2019/0204050 A1 7/2019 Burrow
2019/0204056 A1 7/2019 Burrow
2019/0212117 A1 7/2019 Burrow
2019/0242679 A1 8/2019 Viggiano et al.
2019/0242682 A1 8/2019 Burrow
2019/0242683 A1 8/2019 Burrow
2019/0249967 A1 8/2019 Burrow et al.
2019/0257625 A1 8/2019 Burrow
2019/0285391 A1 9/2019 Menefee, III
2019/0310058 A1 10/2019 Burrow

(56) References Cited

U.S. PATENT DOCUMENTS

| | | | |
|---|---|---|---|
| 2019/0310059 | A1 | 10/2019 | Burrow |
| 2019/0316886 | A1 | 10/2019 | Burrow |
| 2019/0360788 | A1 | 11/2019 | Burrow |
| 2019/0376773 | A1 | 12/2019 | Burrow |
| 2019/0376774 | A1 | 12/2019 | Boss et al. |
| 2019/0383590 | A1 | 12/2019 | Burrow |
| 2019/0390929 | A1 | 12/2019 | Libotte |
| 2020/0011645 | A1 | 1/2020 | Burrow et al. |
| 2020/0011646 | A1 | 1/2020 | Burrow et al. |
| 2020/0025536 | A1 | 1/2020 | Burrow et al. |
| 2020/0025537 | A1 | 1/2020 | Burrow et al. |
| 2020/0033102 | A1 | 1/2020 | Burrow |
| 2020/0033103 | A1 | 1/2020 | Burrow et al. |
| 2020/0041239 | A1 | 2/2020 | Burrow |
| 2020/0049469 | A1 | 2/2020 | Burrow |
| 2020/0049470 | A1 | 2/2020 | Burrow |
| 2020/0049471 | A1 | 2/2020 | Burrow |
| 2020/0049472 | A1 | 2/2020 | Burrow |
| 2020/0049473 | A1 | 2/2020 | Burrow |
| 2020/0056872 | A1 | 2/2020 | Burrow |
| 2020/0109932 | A1 | 4/2020 | Burrow |
| 2020/0149853 | A1 | 5/2020 | Burrow |
| 2020/0158483 | A1 | 5/2020 | Burrow |
| 2020/0200512 | A1 | 6/2020 | Burrow |
| 2020/0200513 | A1 | 6/2020 | Burrow |
| 2020/0208948 | A1 | 7/2020 | Burrow |
| 2020/0208949 | A1 | 7/2020 | Burrow |
| 2020/0208950 | A1 | 7/2020 | Burrow |
| 2020/0225009 | A1 | 7/2020 | Burrow |
| 2020/0248998 | A1 | 8/2020 | Burrow |
| 2020/0248999 | A1 | 8/2020 | Burrow |
| 2020/0249000 | A1 | 8/2020 | Burrow |
| 2020/0256654 | A1 | 8/2020 | Burrow |
| 2020/0263962 | A1 | 8/2020 | Burrow et al. |
| 2020/0263967 | A1 | 8/2020 | Burrow et al. |
| 2020/0278183 | A1 | 9/2020 | Burrow et al. |
| 2020/0292283 | A1 | 9/2020 | Burrow |
| 2020/0300587 | A1 | 9/2020 | Burrow et al. |
| 2020/0300592 | A1* | 9/2020 | Overton ..... F42B 33/02 |
| 2020/0309490 | A1 | 10/2020 | Burrow et al. |
| 2020/0309496 | A1 | 10/2020 | Burrow et al. |
| 2020/0318937 | A1 | 10/2020 | Skowron et al. |
| 2020/0326168 | A1 | 10/2020 | Boss et al. |
| 2020/0363172 | A1 | 11/2020 | Koh et al. |
| 2020/0363173 | A1 | 11/2020 | Burrow |
| 2020/0363179 | A1* | 11/2020 | Overton ..... F42B 33/0285 |
| 2020/0378734 | A1 | 12/2020 | Burrow |
| 2020/0393220 | A1 | 12/2020 | Burrow |
| 2020/0400411 | A9 | 12/2020 | Burrow |
| 2021/0003373 | A1 | 1/2021 | Burrow |
| 2021/0041211 | A1 | 2/2021 | Pennell et al. |
| 2021/0041212 | A1 | 2/2021 | Burrow et al. |
| 2021/0041213 | A1 | 2/2021 | Padgett |
| 2021/0072006 | A1 | 3/2021 | Padgett et al. |
| 2021/0080236 | A1 | 3/2021 | Burrow |
| 2021/0080237 | A1 | 3/2021 | Burrow et al. |
| 2021/0108898 | A1 | 4/2021 | Overton et al. |
| 2021/0108899 | A1 | 4/2021 | Burrow et al. |
| 2021/0123709 | A1 | 4/2021 | Burrow et al. |
| 2021/0131772 | A1 | 5/2021 | Burrow |
| 2021/0131773 | A1 | 5/2021 | Burrow |
| 2021/0131774 | A1 | 5/2021 | Burrow |
| 2021/0140749 | A1 | 5/2021 | Burrow |
| 2021/0148681 | A1 | 5/2021 | Burrow |
| 2021/0148682 | A1 | 5/2021 | Burrow |
| 2021/0148683 | A1 | 5/2021 | Burrow et al. |
| 2021/0156653 | A1 | 5/2021 | Burrow et al. |
| 2021/0164762 | A1 | 6/2021 | Burrow et al. |
| 2021/0223017 | A1 | 7/2021 | Peterson et al. |
| 2021/0254939 | A1 | 8/2021 | Burrow |
| 2021/0254940 | A1 | 8/2021 | Burrow |
| 2021/0254941 | A1 | 8/2021 | Burrow |
| 2021/0254942 | A1 | 8/2021 | Burrow |
| 2021/0254943 | A1 | 8/2021 | Burrow |
| 2021/0254944 | A1 | 8/2021 | Burrow |
| 2021/0254945 | A1 | 8/2021 | Burrow |
| 2021/0254946 | A1 | 8/2021 | Burrow |
| 2021/0254947 | A1 | 8/2021 | Burrow |
| 2021/0254948 | A1 | 8/2021 | Burrow |
| 2021/0254949 | A1 | 8/2021 | Burrow |
| 2021/0270579 | A1 | 9/2021 | Burrow |
| 2021/0270580 | A1 | 9/2021 | Burrow |
| 2021/0270581 | A1 | 9/2021 | Burrow |
| 2021/0270582 | A1 | 9/2021 | Burrow |
| 2021/0270588 | A1 | 9/2021 | Burrow et al. |
| 2021/0278179 | A1 | 9/2021 | Burrow et al. |
| 2021/0302136 | A1 | 9/2021 | Burrow |
| 2021/0302137 | A1 | 9/2021 | Burrow |
| 2021/0325156 | A1 | 10/2021 | Burrow |
| 2021/0325157 | A1 | 10/2021 | Burrow |
| 2021/0333073 | A1 | 10/2021 | Burrow et al. |
| 2021/0333075 | A1 | 10/2021 | Burrow |
| 2021/0341266 | A1 | 11/2021 | Burrow |
| 2021/0341267 | A1 | 11/2021 | Burrow |
| 2021/0341268 | A1 | 11/2021 | Burrow |
| 2021/0341269 | A1 | 11/2021 | Burrow |
| 2021/0341270 | A1 | 11/2021 | Burrow |
| 2021/0341271 | A1 | 11/2021 | Burrow |
| 2021/0341272 | A1 | 11/2021 | Burrow |
| 2021/0341273 | A1 | 11/2021 | Burrow |
| 2021/0348892 | A1 | 11/2021 | Burrow |
| 2021/0348893 | A1 | 11/2021 | Burrow |
| 2021/0348894 | A1 | 11/2021 | Burrow |
| 2021/0348895 | A1 | 11/2021 | Burrow |
| 2021/0348902 | A1 | 11/2021 | Burrow |
| 2021/0348903 | A1 | 11/2021 | Burrow |
| 2021/0348904 | A1 | 11/2021 | Burrow |
| 2021/0364257 | A1 | 11/2021 | Burrow et al. |
| 2021/0364258 | A1 | 11/2021 | Burrow et al. |

FOREIGN PATENT DOCUMENTS

| | | | |
|---|---|---|---|
| DE | 16742 | C | 1/1882 |
| EP | 2625486 | A4 | 8/2017 |
| FR | 1412414 | A | 10/1965 |
| GB | 574877 | A | 1/1946 |
| GB | 783023 | A | 9/1957 |
| RU | 2172467 | C1 | 8/2001 |
| WO | 0034732 | | 6/2000 |
| WO | 2007014024 | A2 | 2/2007 |
| WO | 2012047615 | A1 | 4/2012 |
| WO | 2012097320 | A1 | 7/2012 |
| WO | 2012097317 | A3 | 11/2012 |
| WO | 2013070250 | A1 | 5/2013 |
| WO | 2013096848 | A1 | 6/2013 |
| WO | 2014062256 | A2 | 4/2014 |
| WO | 2016003817 | A1 | 1/2016 |
| WO | 2019094544 | A1 | 5/2019 |
| WO | 2019160742 | A2 | 8/2019 |
| WO | 2020197868 | A3 | 11/2020 |
| WO | 2021040903 | A2 | 3/2021 |

OTHER PUBLICATIONS

IPRP in PCT2019017085 dated Aug. 27, 2020, pp. 1-8.
EESR dated Jul. 29, 2021, pp. 1-9.
EESR dated Jul. 8, 2021, pp. 1-9.
International Search Report and Written Opinion in PCTUS202140825 dated Oct. 13, 2021, pp. 1-11.
AccurateShooter.com Daily Bulletin "New PolyCase Ammunition and Injection-Molded Bullets" Jan. 11, 2015.
International Ammunition Association, Inc. website, published on Apr. 2017, PCP Ammo Variation in U.S. Military Polymer/Metal Cartridge Case R&D, Available on the Internet URL https://forum.cartridgecollectors.org/t/pcp-ammo-variation-in-u-s-military-polyer-metal-cartridge-case-r-d/24400.
International Preliminary Report on Patentability and Written Opinion in PCT/US2018/059748 dated May 12, 2020; pp. 1-8.
International Search Report and Written Opinion for PCTUS201859748 dated Mar. 1, 2019, pp. 1-9.
International Search Report and Written Opinion for PCTUS2019017085 dated Apr. 19, 2019, pp. 1-9.

(56) References Cited

OTHER PUBLICATIONS

International Search Report and Written Opinion in PCT/US2019/040323 dated Sep. 24, 2019, pp. 1-16.
International Search Report and Written Opinion in PCT/US2019/040329 dated Sep. 27, 2019, pp. 1-24.
Korean Intellectual Property Office (ISA), International Search Report and Written Opinion for PCT/US2011/062781 dated Nov. 30, 2012, 16 pp.
Korean Intellectual Property Office (ISA), International Search Report and Written Opinion for PCT/US2015/038061 dated Sep. 21, 2015, 28 pages.
Luck Gunner.com, Review: Polymer Cased Rifle Ammunition from PCP Ammo, Published Jan. 6, 2014, Available on the Internet URL https://www.luckygunner.com/lounge/pcp-ammo-review.
YouTube.com—TFB TV, Published on Jul. 23, 2015, available on Internal URL https://www.youtubecom/watch?v=mCjNkbxHkEE.
ISRWO in PCT/US2020/042258 dated Feb. 19, 2021, pp. 1-12.
"Voluntary Industry Performance Standards for Pressure and Velocity of Centerfire Rifle Ammunition for the Use of Commercial Manufacturers," American National Standard, Sporting Arms and Ammunition Manufacturers' Institute, Inc., SAAMI Z299.4-2015 (2015).

* cited by examiner

METHODS AND DEVICES METERING AND COMPACTING EXPLOSIVE POWDERS

CROSS-REFERENCE TO RELATED APPLICATIONS

This application claims priority based on U.S. Provisional Application Nos. 62/820,536, and 62/820,531 filed Mar. 19, 2019. The contents of which is incorporated by reference in its entirety.

TECHNICAL FIELD OF THE INVENTION

The present invention relates in general to the field of forming compacts from powdered material.

STATEMENT OF FEDERALLY FUNDED RESEARCH

None.

INCORPORATION-BY-REFERENCE OF MATERIALS FILED ON COMPACT DISC

None.

BACKGROUND OF THE INVENTION

Without limiting the scope of the invention, its background is described in connection with the compaction of powder in an ammunition cartridge.

U.S. Pat. No. 1,913,259, entitled, "Explosive cartridge and method of making the same," discloses improvements in explosive cartridges and methods of making the same. The invention provides an improved explosive cartridge comprising a powder-packed shell container having its ends closed and sealed cup-shaped closure members which fit nicely into the ends of the container and are interlocked therewith and sealed thereto by means of a self-hardening sealing medium, such as paraffin wax.

U.S. Pat. No. 4,083,912, entitled, "Process for the compression of black powder," discloses a method for the continuous production of compressed higher density black powder comprising feeding from a feed container means mealy black powder of low density enclosed between upper and lower endless belts into a precompression zone, to produce precompressed black powder, and to expel air contained in said black powder, passing the precompressed black powder through a primary compressing zone containing a primary compression means to achieve a new orientation and displacement of the said black powder, then passing the black powder through a final compressing zone containing a final compression means, while supplying the final pressure to obtain breaking or flow of the crystals as well as crystal lattice displacements of said black powder, and recovering the compressed higher density black powder, each of said primary compression means and said final compression means being capable of building-up compaction pressure as well as being capable of idling, the black powder being moved through said precompression zone, said primary compressing zone and said final compressing zone by synchronized lateral movement of said primary and final compression means towards and away from each other and said black powder being withdrawn from said feed container means onto said lower belt by said movement of said primary and final compression means, whereby the build-up of compaction pressure and the idling time of each of said primary and final compression means is synchronized with the forward movement of said black powder caused by the advancing movement of said primary and final compression means.

U.S. Pat. No. 3,670,928, entitled, "Powder metering device for loading ammunition," discloses a powder metering device includes a powder reservoir, a pouring conduit below the reservoir and an elongated cylindrical channel between the reservoir and the pouring conduit. Inlet and outlet openings provide communication into the channel from the reservoir and the pouring conduit, respectively. A cylindrical slide having a reduced diameter portion intermediate its length is slidably mounted in the channel. The reduced diameter portion provides a metering chamber for receiving powder from the inlet conduit and for emptying the powder out of the outlet conduit. The opposite ends of the metering chamber are movable toward and away from one another so as to vary the size of the metering chamber. Grooves on the slide prevent shearing off of powder particles as the slide moves past the inlet opening. Emptying means on the powder reservoir permit the removal of unused powder without the necessity of inverting the metering device.

SUMMARY OF THE INVENTION

The present invention provides a process for the compacting of black powder, which is suitable for a fully or partially automated manufacturing plant.

The present invention provides a powder compaction device comprising a loading platform positioned above a lower platform; a drive motor connected to the loading platform; a compaction rod operably extending from the drive motor through the loading platform, wherein the compaction rod comprises a metering region adjacent to a loading region extending to a compaction end; a first funnel-shaped device positioned below the loading platform, wherein the first funnel-shaped device comprises a first funnel shaped area extending to a first funnel aperture, wherein the first funnel aperture aligns to allow the metering region of the compaction rod to pass through the first funnel aperture; an ammunition cartridge fixture positioned below the first funnel-shaped device, wherein the ammunition cartridge fixture comprises a second funnel-shaped area extending to a second funnel aperture that connects to an ammunition cartridge shaped void adapted to receive an ammunition cartridge, wherein the second funnel aperture aligns with the first funnel aperture to allow the loading region of the compaction rod to pass through the second funnel aperture and the compaction end in the ammunition cartridge shaped void; a one or more metering reliefs positioned in the metering region of the compaction rod, wherein each of the one or more reliefs has a powder metering volume; a powder reservoir comprising a powder housing connected to a powder gate operably connected to a transport conduit in communication with the first funnel-shaped area to transport a powder from the powder housing to the first funnel-shaped area; a compaction controller in communication with the drive motor and one or more first sensors to control the vertical movement of the compaction rod and to control the force applied to the compaction rod end whereby controlling the compaction of the powder at the compaction end; a powder metering controller in communication with the powder gate and one or more second sensors to control the amount of the powder delivered to the first funnel-shaped area; and a loading controller in communication with the drive motor to control the vertical movement of the metering region of the compaction rod, wherein the loading controller positions the metering region and the one or more metering reliefs above the first funnel aperture to allow the powder into the one or more metering reliefs to load the powder, wherein the loading controller releases the powder by moving the metering region and the one or more metering reliefs through the first funnel aperture to allow the powder to release from the one or more metering reliefs and into the second funnel-shaped area of the ammunition cartridge fixture and through the second funnel aperture. In some embodiments the powder compaction device includes the one or more reliefs comprise a first relief and a second relief. In some embodiments the powder compaction device the first relief and a second relief are about equal. In some embodiments the powder compaction device the first relief and a second relief are not equal. In some embodiments the powder compaction device the one or more reliefs comprise 2, 3, 4, 5, 6, 7, 8, 9 10 or more reliefs. In some embodiments the powder compaction device each of the one or more reliefs are about equal. In some embodiments the powder compaction device each of the one or more reliefs are a different. In some embodiments the powder compaction device each of the one or more reliefs increase in volume. In some embodiments the powder compaction device each of the one or more reliefs decrease in volume. In some embodiments the powder compaction device the compaction rod has a diameter of about the diameter of a projectile aperture in the ammunition cartridge. In some embodiments the powder compaction device the ammunition cartridge shaped void is adapted to receive a 223, 0.243, 0.245, 0.25-06, 0.270, 0.277, 6.8 mm, 0.300, 0.308, 0.338, 0.30-30, 0.30-06, 0.45-70 or 0.50-90, 50 caliber, 45 caliber, 380 caliber or 38 caliber, 5.56 mm, 6 mm, 6.5 mm, 7 mm, 7.62 mm, 8 mm, 9 mm, 10 mm, 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm or 460 mm, 4.2 inch or 8 inch ammunition cartridge. In some embodiments the powder compaction device further comprises a compaction foot connected to the compaction end of the compaction rod to aid in compaction. In some embodiments the powder compaction device the compaction foot is fixed on the compaction end of the compaction rod. In some embodiments the powder compaction device the compaction foot extendable from the compaction end of the compaction rod. In some embodiments the powder compaction device the compaction foot is offset from the compaction rod. In some embodiments the powder compaction device the compaction foot, the compaction rod or both rotate to compact the powder. In some embodiments the powder compaction device the loading region has a loading region diameter and the metering region has a metering region diameter and the loading region diameter is less than the metering region diameter. In some embodiments the powder compaction device the loading region has a one or more feeding regions that allow passage from the second funnel-shaped area into the ammunition cartridge shaped void.

The present invention provides a method of powder compaction in an ammunition cartridge comprising the steps of: providing a powder compaction device comprising a loading platform positioned above a lower platform; a drive motor connected to the loading platform; a compaction rod operably extending from the drive motor through the loading platform, wherein the compaction rod comprises a metering region adjacent to a loading region extending to a compaction end; a first funnel-shaped device positioned below the loading platform, wherein the first funnel-shaped device comprises a first funnel shaped area extending to a first funnel aperture, wherein the first funnel aperture aligns to allow the metering region of the compaction rod to pass through the first funnel aperture; an ammunition cartridge fixture positioned below the first funnel-shaped device, wherein the ammunition cartridge fixture comprises a second funnel-shaped area extending to a second funnel aperture that connects to an ammunition cartridge shaped void adapted to receive an ammunition cartridge, wherein the second funnel aperture aligns with the first funnel aperture to allow the loading region of the compaction rod to pass through the second funnel aperture and the compaction end in the ammunition cartridge shaped void; a one or more metering reliefs positioned in the metering region of the compaction rod, wherein each of the one or more reliefs has a powder metering volume; a powder reservoir comprising a powder housing connected to a powder gate operably connected to a transport conduit in communication with the first funnel-shaped area to transport a powder from the powder housing to the first funnel-shaped area; a compaction controller in communication with the drive motor and one or more first sensors to control the vertical movement of the compaction rod and to control the force applied to the compaction rod end whereby controlling the compaction of the powder at the compaction end; a powder metering controller in communication with the powder gate and one or more second sensors to control the amount of the powder delivered to the first funnel-shaped area; and a loading controller in communication with the drive motor to control the vertical movement of the metering region of the compaction rod, wherein the loading controller positions the metering region and the one or more metering reliefs above the first funnel aperture to allow the powder into the one or more metering reliefs to load the powder, wherein the loading controller releases the powder by moving the metering region and the one or more metering reliefs through the first funnel aperture to allow the powder to release from the one or more metering reliefs and into the second funnel-shaped area of the ammunition cartridge fixture and through the second funnel aperture; positioning an ammunition cartridge in the ammunition cartridge shaped void; moving the metering region into the first funnel shaped area above the first funnel aperture; releasing a first powder load into the first funnel shaped area; filling the one or more reliefs with the powder; moving the metering region through the first funnel aperture to release the powder from the one or more reliefs into the second funnel-shaped area; allowing the powder to pass through the second funnel aperture into the ammunition cartridge; moving the compaction end into the ammunition cartridge to compress the powder; compressing the powder with the compaction end; removing the compaction end from the ammunition cartridge and the second funnel aperture; and removing the ammunition cartridge in the ammunition cartridge shaped void. In some embodiments, the method of powder compaction in an ammunition cartridge further comprises the steps of additional powder compactions by repeating powder compaction steps one or more times, wherein the powder compactions steps comprise moving the metering region into the first funnel shaped area above the first funnel aperture; releasing a first powder load into the first funnel shaped area; filling the one or more reliefs with the powder; moving the metering region through the first funnel aperture to release the powder from the one or more reliefs into the second funnel-shaped area; allowing the powder to pass through the second funnel aperture into the ammunition cartridge; moving the compaction end into the ammunition cartridge to compress the powder; compressing the powder with the compaction end; removing the compaction end from the ammunition cartridge and the second funnel aperture before removing the ammunition cartridge in the ammunition cartridge shaped void. In some embodiments, the method of powder compaction in an ammunition cartridge further comprises a compaction foot connected to the compaction end of the compaction rod to aid in compaction. In some embodiments, the method of powder compaction in an ammunition cartridge includes the compaction foot is fixed on the compaction end of the compaction rod. In some embodiments, the method of powder compaction in an ammunition cartridge includes the compaction foot extendable from the compaction end of the compaction rod and further comprising the step of rotating the compaction rod to rotate the compaction foot. In some embodiments, the method of powder compaction in an ammunition cartridge includes the compaction foot is offset from the compaction rod and further comprising the step of rotating the compaction rod to rotate the compaction foot. In some embodiments, the method of powder compaction in an ammunition cartridge includes the one or more reliefs comprise a first relief and a second relief. In some embodiments, the method of powder compaction in an ammunition cartridge includes the first relief and a second relief are about equal. In some embodiments, the method of powder compaction in an ammunition cartridge includes the first relief and a second relief are not equal. In some embodiments, the method of powder compaction in an ammunition cartridge includes the one or more reliefs comprise 2, 3, 4, 5, 6, 7, 8, 9 10 or more reliefs. In some embodiments, the method of powder compaction in an ammunition cartridge includes each of the one or more reliefs are about equal. In some embodiments, the method of powder compaction in an ammunition cartridge includes each of the one or more reliefs are a different. In some embodiments, the method of powder compaction in an ammunition cartridge includes each of the one or more reliefs increase in volume. In some embodiments, the method of powder compaction in an ammunition cartridge includes each of the one or more reliefs decrease in volume. In some embodiments, the method of powder compaction in an ammunition cartridge includes the compaction rod has a diameter of about the diameter of a projectile aperture in the ammunition cartridge. In some embodiments, the method of powder compaction in an ammunition cartridge includes the ammunition cartridge shaped void is adapted to receive a 223, 0.243, 0.245, 0.25-06, 0.270, 0.277, 6.8 mm, 0.300, 0.308, 0.338, 0.30-30, 0.30-06, 0.45-70 or 0.50-90, 50 caliber, 45 caliber, 380 caliber or 38 caliber, 5.56 mm, 6 mm, 6.5 mm, 7 mm, 7.62 mm, 8 mm, 9 mm, 10 mm, 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm or 460 mm, 4.2 inch or 8 inch ammunition cartridge.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1:
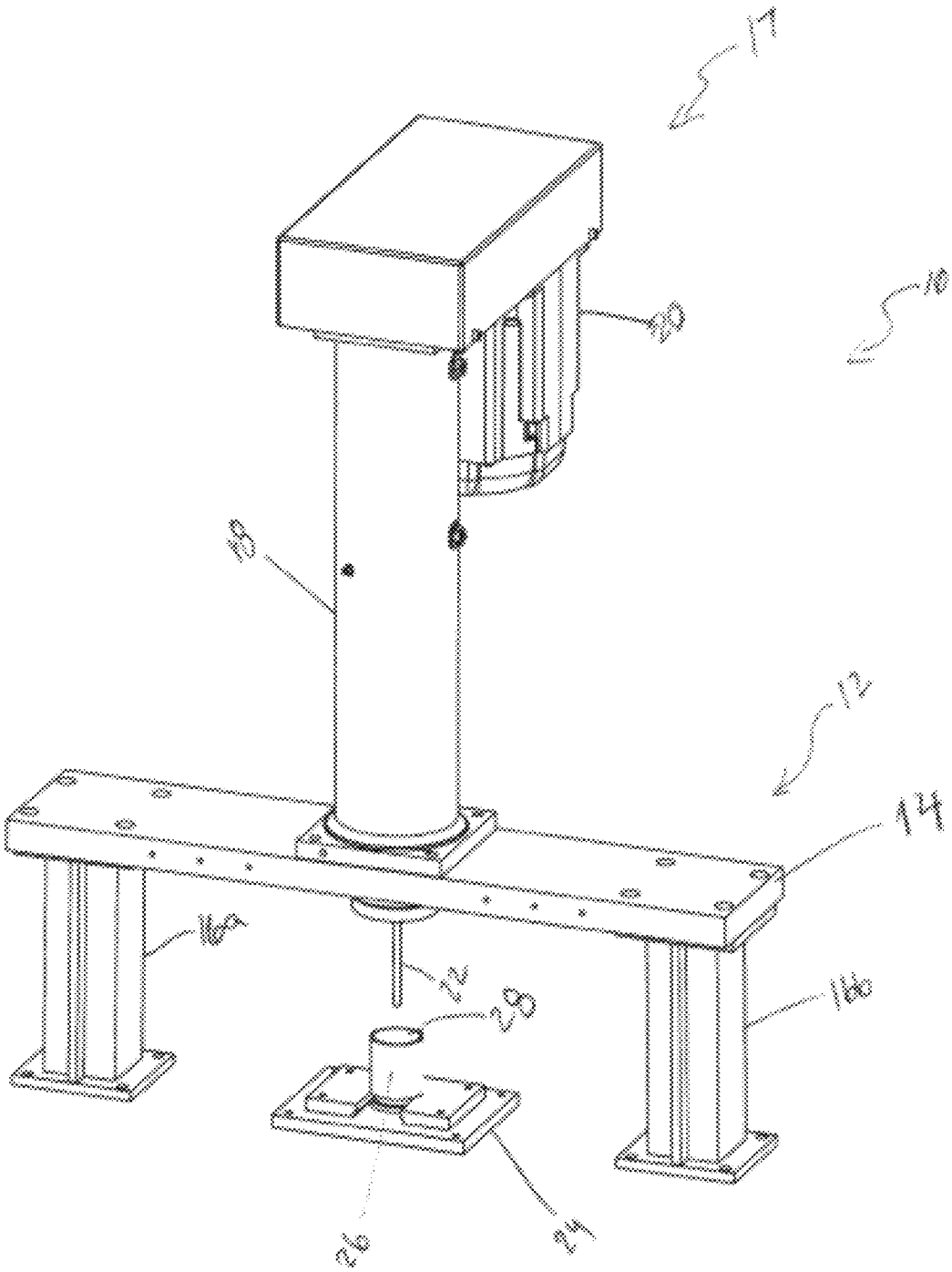
FIG. 1 is a prospective view that depicts one embodiment of the powder loading, metering and compaction device of the present invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

In operation, The present invention provides a powder compaction device comprising a loading platform positioned above a lower platform; a drive motor connected to the loading platform; a compaction rod operably extending from the drive motor through the loading platform, wherein the compaction rod comprises a metering region adjacent to a loading region extending to a compaction end; a first funnel-shaped device positioned below the loading platform, wherein the first funnel-shaped device comprises a first funnel shaped area extending to a first funnel aperture, wherein the first funnel aperture aligns to allow the metering region of the compaction rod to pass through the first funnel aperture; an ammunition cartridge fixture positioned below the first funnel-shaped device, wherein the ammunition cartridge fixture comprises a second funnel-shaped area extending to a second funnel aperture that connects to an ammunition cartridge shaped void adapted to receive an ammunition cartridge, wherein the second funnel aperture aligns with the first funnel aperture to allow the loading region of the compaction rod to pass through the second funnel aperture and the compaction end in the ammunition cartridge shaped void; a one or more metering reliefs positioned in the metering region of the compaction rod, wherein each of the one or more reliefs has a powder metering volume; a powder reservoir comprising a powder housing connected to a powder gate operably connected to a transport conduit in communication with the first funnel-shaped area to transport a powder from the powder housing to the first funnel-shaped area; a compaction controller in communication with the drive motor and one or more first sensors to control the vertical movement of the compaction rod and to control the force applied to the compaction rod end whereby controlling the compaction of the powder at the compaction end; a powder metering controller in communication with the powder gate and one or more second sensors to control the amount of the powder delivered to the first funnel-shaped area; and a loading controller in communication with the drive motor to control the vertical movement of the metering region of the compaction rod, wherein the loading controller positions the metering region and the one or more metering reliefs above the first funnel aperture to allow the powder into the one or more metering reliefs to load the powder, wherein the loading controller releases the powder by moving the metering region and the one or more metering reliefs through the first funnel aperture to allow the powder to release from the one or more metering reliefs and into the second funnel-shaped area of the ammunition cartridge fixture and through the second funnel aperture.

The present invention provides a method of powder compaction in an ammunition cartridge comprising the steps of: providing a powder compaction device comprising a loading platform positioned above a lower platform; a drive motor connected to the loading platform; a compaction rod operably extending from the drive motor through the loading platform, wherein the compaction rod comprises a metering region adjacent to a loading region extending to a compaction end; a first funnel-shaped device positioned below the loading platform, wherein the first funnel-shaped device comprises a first funnel shaped area extending to a first funnel aperture, wherein the first funnel aperture aligns to allow the metering region of the compaction rod to pass through the first funnel aperture; an ammunition cartridge fixture positioned below the first funnel-shaped device, wherein the ammunition cartridge fixture comprises a second funnel-shaped area extending to a second funnel aperture that connects to an ammunition cartridge shaped void adapted to receive an ammunition cartridge, wherein the second funnel aperture aligns with the first funnel aperture to allow the loading region of the compaction rod to pass through the second funnel aperture and the compaction end in the ammunition cartridge shaped void; a one or more metering reliefs positioned in the metering region of the compaction rod, wherein each of the one or more reliefs has a powder metering volume; a powder reservoir comprising a powder housing connected to a powder gate operably connected to a transport conduit in communication with the first funnel-shaped area to transport a powder from the powder housing to the first funnel-shaped area; a compaction controller in communication with the drive motor and one or more first sensors to control the vertical movement of the compaction rod and to control the force applied to the compaction rod end whereby controlling the compaction of the powder at the compaction end; a powder metering controller in communication with the powder gate and one or more second sensors to control the amount of the powder delivered to the first funnel-shaped area; and a loading controller in communication with the drive motor to control the vertical movement of the metering region of the compaction rod, wherein the loading controller positions the metering region and the one or more metering reliefs above the first funnel aperture to allow the powder into the one or more metering reliefs to load the powder, wherein the loading controller releases the powder by moving the metering region and the one or more metering reliefs through the first funnel aperture to allow the powder to release from the one or more metering reliefs and into the second funnel-shaped area of the ammunition cartridge fixture and through the second funnel aperture; positioning an ammunition cartridge in the ammunition cartridge shaped void; moving the metering region into the first funnel shaped area above the first funnel aperture; releasing a first powder load into the first funnel shaped area; filling the one or more reliefs with the powder; moving the metering region through the first funnel aperture to release the powder from the one or more reliefs into the second funnel-shaped area; allowing the powder to pass through the second funnel aperture into the ammunition cartridge; moving the compaction end into the ammunition cartridge to compress the powder; compressing the powder with the compaction end; removing the compaction end from the ammunition cartridge and the second funnel aperture; and removing the ammunition cartridge in the ammunition cartridge shaped void.

FIG. 1 is a prospective view that depicts one embodiment of the powder loading, metering and compaction device of the present invention. The compaction device 10 includes a frame 12 which may be constructed of polymer, plastic, metal or any other desirable rigid material. The frame 12 includes a platform 14 that is supported by one or more risers 16*a* and 16*b*. The one or more risers 16*a* and 16*b* may be constructed of polymer, plastic, metal or any other desirable rigid material and may be of any height necessary for the operation of the compaction device 10. A drive device 17 is connected to the platform 14. The drive device 17 include a vertical tube 18 housing a movable compaction rod 22. The vertical tube 18 extending from the platform 14 to a drive motor 20 to move the compaction rod 22. Although the drive motor 20 is depicted at the top of the vertical tube 18 it may be positioned at any location allowing activation of the compaction rod 22 with the desired degree of movement. The drive motor 20 may be a pneumatic or electric motor that is gear, belt, chain or directly driven to actuate the compaction rod 22. The platform 14 includes a compaction rod aperture (not shown) position in communication the vertical tube 18 to allow passage of the compaction rod 22 through the platform 14. The compaction rod 22 extends through the compaction rod aperture (not shown) and is positioned in the vertical tube 18 in operable communication with the drive motor 20 which moves the compaction rod 22 toward and away from the platform 14. A holding platform 24 is aligned with and in communication with the compaction rod aperture (not shown). The holding platform 24 slidably accepts an ammunition cartridge fixture 26. The ammunition cartridge fixture 26 is slidably secured in the adaptor platform 24 to align the compaction rod aperture (not shown) and the compaction rod 22 with the ammunition cartridge fixture 26. The ammunition cartridge fixture 26 includes a funnel-shaped opening 28 with a funnel aperture (not shown) connected to an interior chamber (not shown) within the ammunition cartridge fixture 26. The funnel aperture (not shown) and compaction rod aperture (not shown) are aligned to allow the compaction rod 22 enter the interior chamber (not shown) of the ammunition cartridge fixture 26.

The drive motor 20 may be manually controlled or automatically controlled. The drive motor 20 includes one or more sensors to measure, record, transmit, store, or report one or more physical measurements. For example, the one or more sensors may be force and/or distance sensor that measure the force applied to the compaction rod, the force exerted by the motor, the compression force applied at the tip of the compaction rod, the distance the compaction rod moves, etc. The data from the sensors may be stored, reported and/or used to control the operation of the drive motor. For example, the sensor may record the force applied to the powder and when a specific compression force (e.g., 5-5000 psi) is reached the motor will reverse direction to move the compaction rod opposite direction. The specific parameters (distance or force curve) may vary and depend on the specific powders, caliber, compaction rod diameter or tip profile being used.

Figure 2:
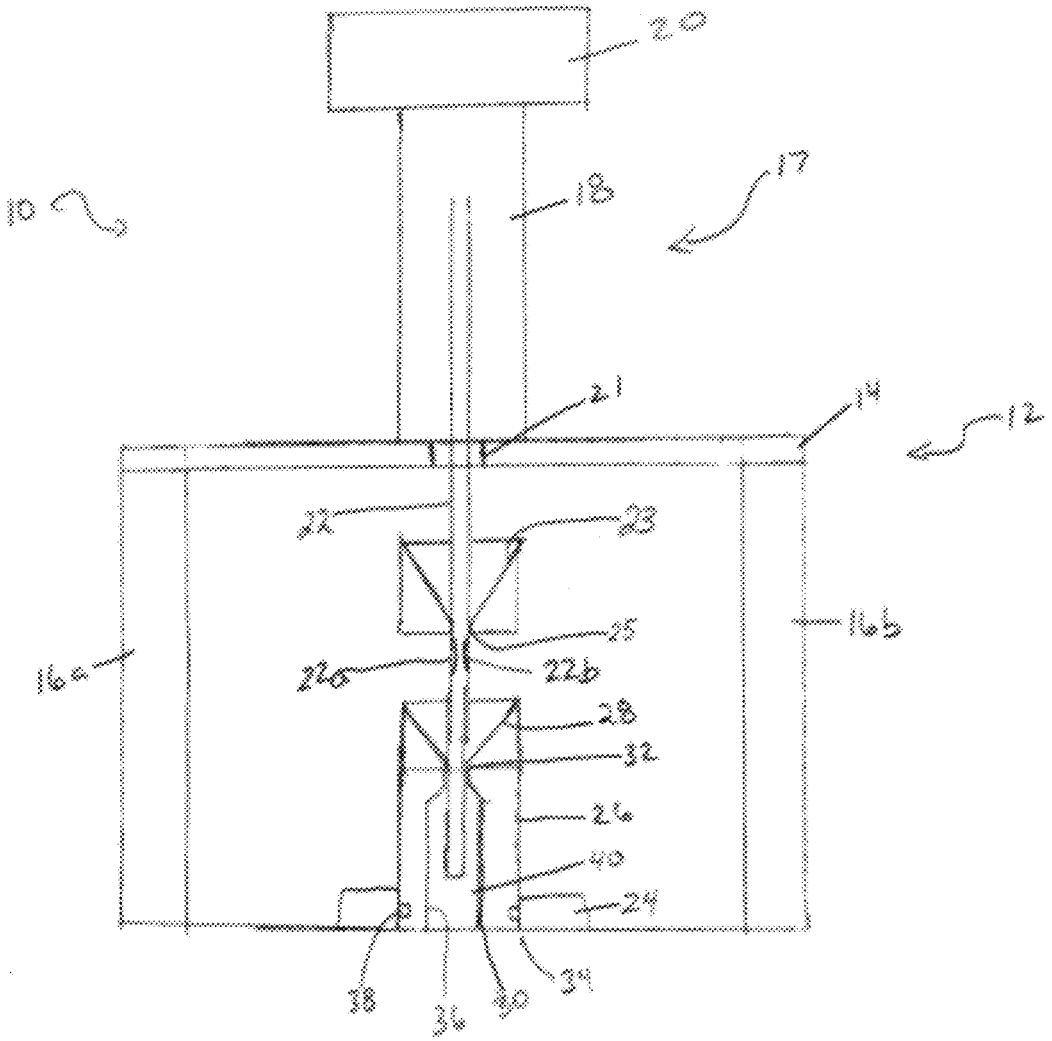
FIG. 2 depicts a cut through image of one embodiment of the powder loading metering and compaction device of the present invention.

FIG. 2 is a prospective view that depicts one embodiment of the powder loading, metering and compaction device of the present invention. The compaction device 10 includes a frame 12 which may be constructed of polymer, plastic, metal or any other desirable rigid material. The frame 12 includes a platform 14 that is supported by one or more risers 16*a* and 16*b*. The one or more risers 16*a* and 16*b* may be constructed of polymer, plastic, metal or any other desirable rigid material and may be of any height necessary for the operation of the compaction device 10. A drive device 17 is connected to the platform 14. The drive device 17 include a vertical tube 18 housing, a drive motor 20 and a movable compaction rod 22. The vertical tube 18 extends from the platform 14 to the drive motor 20 to move the compaction rod 22. Although the drive motor 20 is depicted at the top of the vertical tube 18 it may be positioned at any location allowing activation and movement of the compaction rod 22 to the desired degree of movement. The drive motor 20 may be a pneumatic or electric motor that is gear, belt chain or directly driven to actuate the compaction rod 22. The platform 14 includes a compaction rod aperture 21 position in communication the vertical tube 18 to allow passage of the compaction rod 22 through the platform 14. The compaction rod 22 extends through the compaction rod aperture 21 and is positioned in the vertical tube 18 in operable communication with the drive motor 20 which moves the compaction rod 22 toward and away from the platform 14. A first funnel-shaped device 23 for housing powder is positioned below the platform 14. A first funnel aperture 25 is positioned in the first funnel-shaped device 23 and aligned with the compaction rod aperture 21 to allow the compaction rod 22 to pass through the compaction rod aperture 21 and through the first funnel aperture 25. A holding platform 24 is aligned with and in communication with the compaction rod aperture 21 and the first funnel aperture 25. The holding platform 24 accepts an ammunition cartridge fixture 26. The ammunition cartridge fixture 26 includes a funnel-shaped opening 28 with a funnel aperture 32 extending into an interior chamber 30. The funnel aperture 32 aligns with the first funnel aperture 25 and the compaction rod aperture 21 to accommodate the movement of the compaction rod 22 into the interior chamber 30. The ammunition cartridge fixture 26 may be constructed of polymer, plastic, metal or any other desirable rigid material. The interior chamber 30 of the ammunition cartridge fixture 26 has the profile of the ammunition cartridge being loaded such that the interior chamber 30 mimics the shape of an ammunition cartridge chamber. The ammunition cartridge fixture 26 supports the ammunition cartridge on all sides as it is supported in a chamber of the corresponding rifle. The ammunition cartridge being loaded may be any ammunition cartridge caliber. For example, loading a 7.62 mm ammunition cartridge requires an interior chamber 30 with a profile that mates to the 7.62 mm ammunition cartridge.

The ammunition cartridge fixture 26 is aligned and positioned below the first funnel-shaped device 23. The ammunition cartridge fixture 26 includes a funnel-shaped opening 28 positioned adjacently above and in communication with the interior chamber 30 through the funnel aperture 32. The funnel-shaped opening 28 allows propellant to be funneled into the ammunition cartridge (not shown) placed into the ammunition cartridge fixture 26. The ammunition cartridge fixture 26 includes a lower groove 34 that is adapted to slide into the tongue 38 of the adaptor platform 24 to secure the ammunition cartridge fixture 26 in position. In one embodiment, the ammunition cartridge fixture 26 is slidably secured in the adaptor platform 24 to align the compaction rod aperture 21, the first funnel aperture 25 and the funnel aperture 32 to allow movement of the compaction rod 22 into the interior chamber 30. In another embodiment, the ammunition cartridge fixture 26 is comprised of 2, 3, 4, or more sections that are moved together to form the ammunition cartridge fixture 26.

The compaction rod 22 includes reliefs 22*a* and 22*b* located in the wall of the compaction rod 22. The reliefs 22*a* and 22*b* are positioned to correspond to the position of the first funnel aperture 25 to act as a metering device. Initially the reliefs 22*a* and 22*b* are positioned in the first funnel-shaped device 23 above the first funnel aperture 25. Powder added to the first funnel-shaped device 23 fills the reliefs 22*a* and 22*b*. As compaction rod 22 is moved by the drive motor 20 the reliefs 22*a* and 22*b* move through the first funnel aperture 25 to locate the reliefs 22*a* and 22*b* below the first funnel aperture 25. As the reliefs 22*a* and 22*b* upon passing through the first funnel aperture 25 the powder is released. The released powder is transferred to the funnel-shaped opening 28. The size, shape, number, location, depth, etc. of the reliefs 22*a* and 22*b* may be varied to finetune the amount of powder released. The powder is then transferred into the interior chamber 30. The compaction rod 22 is moved by the drive motor 20 through the funnel aperture 32 and into the interior chamber 30 for compaction. The compaction rod 22 may have a compaction rod tip at the compaction end that is flat, convex, concave, curved, angled or any other shape. In addition, the compaction rod 22 may be hollow to allow passage through the compaction rod 22. The compaction rod 22 may be removable and replicable either entirely or partially. The compaction rod 22 may be adapted to receive a replaceable compaction rod tip depending on the particular application.

The drive motor 20 may be manually controlled or automatically controlled. The drive motor 20 includes one or more sensors to measure, record, transmit, store, or report one or more physical measurements. For example, the one or more sensors may be force and/or distance sensor that measure the force applied to the compaction rod, the force exerted by the motor, the compression force applied at the tip of the compaction rod, the distance the compaction rod moves, etc. The data from the sensors may be stored, reported and/or used to control the operation of the drive motor. For example, the sensor may record the force applied to the powder and when a specific compression force (e.g., 5-5000 psi) is reached the motor will reverse direction to move the compaction rod opposite direction. The specific parameters (distance or force curve) may vary and depend on the specific powders, caliber, compaction rod diameter or tip profile being used.

In operation an ammunition cartridge 36 to be loaded with powder is positioned in the ammunition cartridge fixture 26 such that the ammunition cartridge 36 mates to the interior chamber 30. The ammunition cartridge fixture 26 is positioned in the adaptor platform 24 by sliding the lower groove 34 of the ammunition cartridge fixture 26 into the tongue 38 of the adaptor platform 24. The ammunition cartridge fixture 26 is secured in the adaptor platform 24 allowing the ammunition cartridge interior 40 to be accessible through the funnel-shaped opening 28. Powder is placed in the first funnel-shaped device 23 and the compaction rod 22 extends into the funnel-shaped opening 28 and through the first funnel aperture 25. The reliefs 22*a* and 22*b* of the compaction rod 22 are positioned in the first funnel-shaped device 23 and filled with the powder. The drive motor 20 moves the compaction rod 22 to transition the reliefs 22*a* and 22*b* and powder contained therein through the first funnel aperture 25. As the reliefs 22*a* and 22*b* exit the first funnel aperture 25 the powder contained in the reliefs 22*a* and 22*b* is released. The controlled volume and release of the powder serves to meters the amount of powder delivered for compaction. The powder is then transported into the funnel-shaped opening 28 which is then funneled through the funnel aperture 32 and into the ammunition cartridge 36. The compaction rod 22 is moved through the funnel aperture 32 and into the ammunition cartridge interior 40 to contact the deposited powder for compaction. The drive motor 20 is activated to move the compaction rod 22 contacts the powder and moved to compress the powder to a specific preset distance of movement or pressure. Once the powder is compressed the compaction rod 22 may be removed (either manually or automatically), the ammunition cartridge fixture 26 is removed from the adaptor platform 24 and the ammunition cartridge 36 removed from the interior chamber 30. During operation the powder may be added in stages and then compressed at each stage to form a layered powder configuration. Alternatively, the powder may be added in single stage or layer and then compressed. Each stage or layer may use the same powder or a different powder. Similarly, each stage or layer may be compressed to a different degree of compaction. As a result, the individual cartridge powder compaction may be fine-tuned through the adjustment of the type of powder, the number of powders, the distribution (or layers) of the powders, the amount of compression, the compaction of the layers of the powders, etc.

Figure 3:
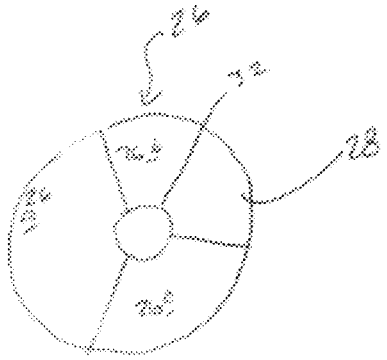
FIG. 3 is a top down view of one embodiment of the ammunition cartridge fixture of the present invention.

FIG. 3 is a top down view of one embodiment of the ammunition cartridge fixture of the present invention. The ammunition cartridge fixture 26 which may be constructed of polymer, plastic, metal or any other desirable rigid material. The ammunition cartridge fixture 26 includes a funnel-shaped opening 28 with a funnel aperture 32 that passes into an interior chamber (not shown). The ammunition cartridge fixture 26 is seen as a multipart fixture having body portions 26*a*, 26*b* and 26*c* that mate to complete the funnel-shaped opening 28 with a funnel aperture 32 that passes into an interior chamber (not shown).

Figure 4:
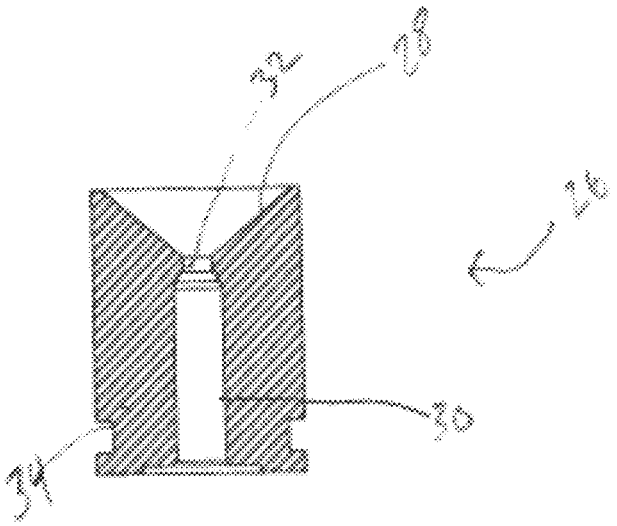
FIG. 4 is a cut through image of one embodiment of the ammunition cartridge fixture of the present invention.

FIG. 4 is a cut through image of one embodiment of the ammunition cartridge fixture of the present invention. The ammunition cartridge fixture 26 which may be constructed of polymer, plastic, metal or any other desirable rigid material. The ammunition cartridge fixture 26 includes an interior chamber 30 which has the profile of the ammunition cartridge being loaded. The interior chamber 30 mimics the shape of an ammunition cartridge chamber and supports the ammunition cartridge on all sides as in the chamber of the corresponding rifle. The ammunition cartridge being loaded may be any ammunition cartridge caliber. For example, loading a 7.62 mm ammunition cartridge requires an interior chamber 30 with a profile that mates to the 7.62 mm ammunition cartridge. The ammunition cartridge fixture 26 includes a funnel-shaped opening 28 positioned adjacently above and in communication with the interior chamber 30 through the funnel aperture 32. The funnel-shaped opening 28 allows powder to be funneled into the ammunition cartridge (not shown) secured in the interior chamber 30 of the ammunition cartridge fixture 26. The ammunition cartridge fixture 26 includes a lower groove 34 that is adapted to slide into the adaptor platform (not shown) to secure the ammunition cartridge fixture 26 in position.

Figure 5:
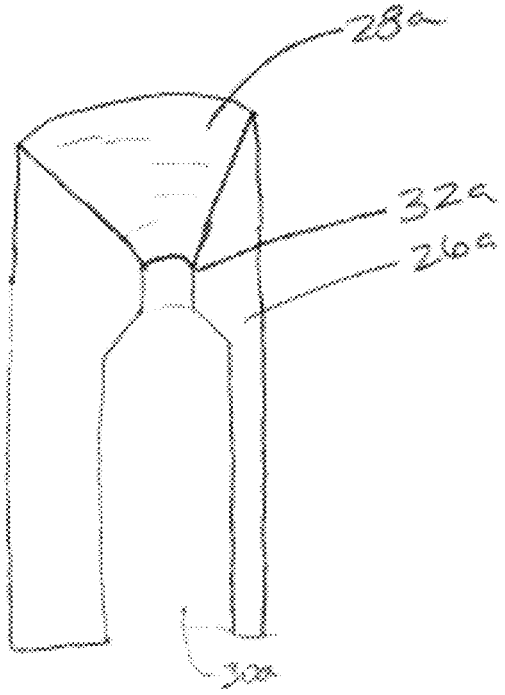
FIG. 5 is a cut through image of one embodiment of a segment of the ammunition cartridge fixture of the present invention.

FIG. 5 is a cut through image of one embodiment of a segment of the ammunition cartridge fixture of the present invention. The ammunition cartridge fixture segment 26*a* is a portion of the ammunition cartridge fixture (not shown) that when combined makes up the completed ammunition cartridge fixture (not shown). The ammunition cartridge fixture segment 26*a* includes a funnel-shaped opening 28*a* the funnels to a funnel aperture segment 32*a* that is in communication with the interior chamber segment 30*a* which has the profile of a portion of the ammunition cartridge being loaded. The interior chamber segment 30*a* mimics the shape of an ammunition cartridge chamber. Each of the ammunition cartridge fixture segment 26*a* supports a portion of the ammunition cartridge (not shown) on the side wall (not shown), the neck (not shown) and the nose (not shown) as the ammunition cartridge is supported in the chamber of the corresponding rifle. In the depicted embodiment the completed ammunition cartridge fixture (not shown) is made up of 3 ammunition cartridge fixture segments. However, the ammunition cartridge fixture (not shown) may be made of 2, 3, 4, or more ammunition cartridge fixture segment that are moved together to form the ammunition cartridge fixture 26. Similarly, the funnel-shaped opening may be a single member that is in communication with a multipiece ammunition cartridge fixture having 2, 3, 4, or more ammunition cartridge fixture segment that are moved together to form the interior chamber (not shown). The ammunition cartridge fixture segments when mated supports the ammunition cartridge on all sides as in a chamber of the corresponding rifle. The ammunition cartridge being loaded may be any ammunition cartridge caliber. For example, loading a 7.62 mm ammunition cartridge requires an interior chamber 30 with a profile that mates to the 7.62 mm ammunition cartridge.

The powder may be any powder or propellant know to the skilled artisan for use in ammunition loading. For example, vihta vuori n310, alliant blue dot, hodgdon varget, accurate arms nitro 100, accurate arms no. 7, imr 4320, alliant e3, alliant pro reach, winchester 748, hodgdon titewad, hodgdon longshot, hodgdon bl-c(2), ramshot competition, alliant 410, hodgdon cfe 223, alliant red dot, alliant 2400, hodgdon leverevolution, alliant promo, ramshot enforcer, hodgdon h380, hodgdon clays, accurate arms no. 9, ramshot big game, imr red, accurate arms 4100, vihtavuori n540, alliant clay dot, alliant steel, winchester 760, hodgdon hi-skor 700-x, norma 8123, hodgdon h414, alliant bullseye, vihtavuori n110, vihtavuori n150, imr target, hodgdon lil' gun, accurate arms 2700, hodgdon titegroup, hodgdon 110, imr 4350, alliant american select, winchester 296, imr 4451, accurate arms solo 1000, imr 4227, hodgdon h4350, alliant green dot, accurate arms 5744, alliant reloder 17, imr green, accurate arms 1680, accurate arms 4350, winchester wst, hodgdon cfe blk, norma 204, hodgdon trail boss, norma 200, hodgdon hybrid 100v, winchester super handicap, alliant reloder 7, vihtavuori n550, hodgdon international, imr 4198, alliantreloder 19, accurate arms solo 1250, hodgdon h4198, imr 4831, vihtavuori n320, vihta vuori n120, ramshot hunter, accurate arms no. 2, hodgdon h322, accurate arms 3100, ramshot zip, accurate arms 2015br, vihtavuori n160, hodgdon hp-38, alliant reloder 10×, hodgdon h4831 & h4831sc, winchester 231, vihta vouri n130, hodgdon superformance, alliant 20/28, imr 3031, imr 4955, winchester 244, vihtavouri n133, winchester supreme 780, alliant unique, hodgdon benchmark, norma mrp, hodgdon universal, hodgdon h335, alliant reloder 22, imr unequal, ramshot x-terminator, vihtavuori n560, alliant power pistol, accurate arms 2230, vihtavuori n165, vihta vuori n330, accurate arms 2460s, imr 7828 & imr 7828 ssc, alliant herco, imr 8208 xbr, alliant reloder 25, winchester wsf, ramshot tac, vihtavuori n170, vihtavuori n340, hodgdon h4895, accurate arms magpro, hodgdon hi-skor 800-x, vihtavuori n530 140 imr 7977, ramshot true blue, imr 4895, hodgdon h1000, accurate arms no. 5, vihtavuori n135, ramshot magnum, hodgdon hs-6, alliant reloder 12, hodgdon retumbo, winchester autocomp, accurate arms 24951r, imr 8133, hodgdon cfe pistol, imr 4166, vihtavuori n570, ramshot silhouette, imr 4064, accurate arms 8700, vihtavuori 3n37, norma 202, vihta vuori 24n41, vihtavuori n350, accurate arms 4064, hodgdon 50bmg, vihtavuori 3n318, accurate arms 2520, hodgdon us869, imr blue, alliant reloder 15, vihtavuori 20n29, or other similar powders or propellants.

The present invention is not limited to the described caliber and is believed to be applicable to other calibers as well. This includes various small, medium and large caliber munitions, including 5.56 mm, 7.62 mm, 308, 338, 3030, 3006, and .50 caliber ammunition cartridges, as well as medium/small caliber ammunition such as 380 caliber, 38 caliber, 9 mm, 10 mm, 20 mm, 25 mm, 30 mm, 40 mm, 45 caliber and the like. The projectile and the corresponding cartridge may be of any desired size, e.g., 0.223, 0.243, 0.245, 0.25-06, 0.270, 0.277, 6.8 mm, 0.300, 0.308, 0.338, 0.30-30, 0.30-06, 0.45-70 or 0.50-90, 50 caliber, 45 caliber, 380 caliber or 38 caliber, 5.56 mm, 6 mm, 6.5 mm, 7 mm, 7.62 mm, 8 mm, 9 mm, 10 mm, 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm or 460 mm, 4.2 inch or 8 inch. The cartridges, therefore, are of a caliber between about 0.05 and about 5 inches. Thus, the present invention is also applicable to the sporting goods industry for use by hunters and target shooters.

The present invention includes a motor controller in communication with at least the drive motor and/or one or more sensors. The motor controller may also include one or more microprocessors, a servo amplifier for driving the motor and a proportional integral derivative (PID) filter for controlling the motor based upon feedback from the motor and/or the one or more sensors. The motor controller may also be connected to a computer or memory module that contain information regarding parameters of the motion of the drive motor to control the force, actual position, velocity, errors and/or motor status. The position, force, velocity or acceleration of the compaction rod or the drive motor can be programmed into the controller with extreme precision in any of those parameters, yielding extremely fine resolution and control over the drive motor. The controller has a communications port that may be accessed by an RS232 plug from a personal computer. Two or more controllers can be linked together via their communication ports to provide multi-axis motion with the controllers and their connected motors synchronized. A peripheral device port located adjacent to the communications port on a back end of the controller affords connections for devices such as a flat panel display, which may be mounted on the controller and display information regarding the motor or controller, or joystick for controlling the motor directly.

In addition, the present invention may include a powder reservoir in communication with the funnel-shaped opening directly or through a pouring conduit below the reservoir and extending to the funnel-shaped opening either with or without a gate or slide to control flow.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, MB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A powder compaction device comprising a loading platform positioned above a lower platform;

a drive motor connected to the loading platform;

a compaction rod operably extending from the drive motor through the loading platform, wherein the compaction rod comprises a metering region adjacent to a loading region extending to a compaction end;

a first funnel-shaped device positioned below the loading platform, wherein the first funnel-shaped device comprises a first funnel shaped area extending to a first funnel aperture, wherein the first funnel aperture aligns to allow the metering region of the compaction rod to pass through the first funnel aperture;

an ammunition cartridge fixture positioned below the first funnel-shaped device, wherein the ammunition cartridge fixture comprises a second funnel-shaped area extending to a second funnel aperture that connects to an ammunition cartridge shaped void adapted to receive an ammunition cartridge, wherein the second funnel aperture aligns with the first funnel aperture to allow the loading region of the compaction rod to pass through the second funnel aperture and the compaction end in the ammunition cartridge shaped void;

a one or more metering reliefs positioned in the metering region of the compaction rod, wherein each of the one or more reliefs has a powder metering volume;

a powder reservoir comprising a powder housing connected to a powder gate operably connected to a transport conduit in communication with the first funnel-shaped area to transport a powder from the powder housing to the first funnel-shaped area;

a compaction controller in communication with the drive motor and one or more first sensors to control the vertical movement of the compaction rod and to control the force applied to the compaction rod end whereby controlling the compaction of the powder at the compaction end;

a powder metering controller in communication with the powder gate and one or more second sensors to control the amount of the powder delivered to the first funnel-shaped area; and a loading controller in communication with the drive motor to control the vertical movement of the metering region of the compaction rod, wherein the loading controller positions the metering region and the one or more metering reliefs above the first funnel aperture to allow the powder into the one or more metering reliefs to load the powder, wherein the loading controller releases the powder by moving the metering region and the one or more metering reliefs through the first funnel aperture to allow the powder to release from the one or more metering reliefs and into the second funnel-shaped area of the ammunition cartridge fixture and through the second funnel aperture.

2. The powder compaction device of claim 1, wherein the one or more metering reliefs consist of a first relief and a second relief.

3. The powder compaction device of claim 2, wherein the powder metering volume of the first relief is substantially equal in volume to the powder metering volume of the second relief.

4. The powder compaction device of claim 1, wherein the one or more reliefs consist of a plurality of reliefs.

5. The powder compaction device of claim 1, wherein each of the one or more metering reliefs defines a powder metering volume, wherein all powder metering volumes so defined have substantially equivalent volumes.

6. The powder compaction device of claim 1, wherein each metering relief has a powder metering volume that is different in volume from every other power metering volume among the metering reliefs.

7. The powder compaction device of claim 1, wherein each of the one or more reliefs increase in volume.

8. The powder compaction device of claim 1, wherein each of the one or more reliefs decrease in volume.

9. The powder compaction device of claim 1, wherein the compaction rod has a diameter substantially equal to the standard diameter of a projectile aperture in the ammunition cartridge, wherein the ammunition cartridge has standard dimensions for the specific caliber of ammunition.

10. The powder compaction device of claim 1, wherein the ammunition cartridge shaped void is adapted to receive a 223, 0.243, 0.245, 0.25-06, 0.270, 0.277, 6.8 mm, 0.300, 0.308, 0.338, 0.30-30, 0.30-06, 45-70 or 0.50-90, 50 caliber, 45 caliber, 380 caliber or 38 caliber, 5.56 mm, 6 mm, 6.5 mm, 7 mm, 7.62 mm, 8 mm, 9 mm, 10 mm, 12.7 mm, 14.5 mm, 14.7 mm, 20 mm, 25 mm, 30 mm, 40 mm, 57 mm, 60 mm, 75 mm, 76 mm, 81 mm, 90 mm, 100 mm, 105 mm, 106 mm, 115 mm, 120 mm, 122 mm, 125 mm, 130 mm, 152 mm, 155 mm, 165 mm, 175 mm, 203 mm or 460 mm, 4.2 inch or 8 inch ammunition cartridge.

11. The powder compaction device of claim 1, further comprising a compaction foot connected to the compaction end of the compaction rod to aid in compaction.

12. The powder compaction device of claim 11, wherein the compaction foot is fixed on the compaction end of the compaction rod.

13. The powder compaction device of claim 11, wherein the compaction foot extendable from the compaction end of the compaction rod.

14. The powder compaction device of claim 11, wherein the compaction foot is offset from the compaction rod.

15. The powder compaction device of claim 11, wherein the compaction foot, the compaction rod or both rotate to compact the powder.

16. The powder compaction device of claim 1, wherein the loading region has a loading region diameter and the metering region has a metering region diameter and the loading region diameter is less than the metering region diameter.

17. The powder compaction device of claim 1, wherein the loading region has a one or more feeding regions that allow passage from the second funnel-shaped area into the ammunition cartridge shaped void.

* * * * *